United States Patent [19]

Ramboz

[11] Patent Number: 4,604,817

[45] Date of Patent: Aug. 12, 1986

[54] SNOWSHOE

[76] Inventor: Gérard Ramboz, Rue Allamand, 74490 Saint Jeoire en Faucigny, France

[21] Appl. No.: 706,092

[22] Filed: Feb. 27, 1985

[30] Foreign Application Priority Data

Feb. 29, 1984 [FR] France ..... 84 03247

[51] Int. Cl.[4] ..... A63C 13/00; A43B 5/04

[52] U.S. Cl. ..... 36/125; 36/7.5; 36/116

[58] Field of Search ..... 36/116, 7.5, 7.6, 122–125, 36/113.1

[56] References Cited

U.S. PATENT DOCUMENTS 2,486,868 11/1949 Mueller .
2,769,250 11/1956 Rinkinen ..... 36/124
3,060,600 10/1962 Howe .
4,161,071 7/1979 Maul .
4,199,880 4/1980 Frey ..... 36/7.5 X
4,259,793 4/1981 Morgan, Jr. et al. ..... 36/125
4,351,121 9/1982 Wallace ..... 36/125

FOREIGN PATENT DOCUMENTS 542885 7/1957 Canada ..... 36/125
2429027 1/1980 France .

*Primary Examiner*—James Kee Chi
*Attorney, Agent, or Firm*—Ratner & Prestia

[57] ABSTRACT

A snowshoe or racket is provided comprising a frame with T cross section having a pivot pin on which is hingedly mounted a pivoting structure for fixing different sized shoes. An intermediate spacer connects together the side members of the frame below a central lattice forming a perforated bearing surface. A fin extends the outer side member outwardly over the whole of its length and forms a sliding bearing surface. The pivoting structure comprises a rigid base plate with a front stirrup piece and a rear heel piece.

13 Claims, 15 Drawing Figures

SNOWSHOE

BACKGROUND OF THE INVENTION

1. Field of the Invention

The present invention relates to a snowshoe or racket for easily moving with or without load in any kind of snow over various snow-covered reliefs.

This snowshoe finds applications in fields such as tourism, walking, competitions, troup movements, first aid.

In some known racket patterns, the shoes are fixed flat to a lattice work or flexible plate forcing the user to lift his legs in an exaggerated way. The result is slow and laboured progress. At each step, the snow on the rear part of the racket is thrown onto the back of the user, causing him a source of annoyance with the consequent risks of making him cold.

In most known rackets, the foot is fixed to the racket in a central position, forcing the user to space his legs abnormally apart for moving.

2. Description of the Prior Art

Rackets have been proposed comprising means for causing the shoe to pivot with respect to the plane of the racket, along a transverse axis. Thus, U.S. Pat. No. 4,161,071 describes a racket comprising a substantially flat rigid tubular frame formed from an inner side member and an outer side member joined together by a front end cross piece and a rear end cross piece. The frame is fixed to a flexible and perforated central bearing surface with a toe passage. A transverse rotating pin, disposed at the rear end of the toe passage, has its two ends retained by the side members; its intermediate part supports a pivoting structure receiving the front part of the shoe, fastening means providing fastening of the shoe to the pivoting structure. The pivoting structure is offset slightly towards the inner side member of the frame, and means allow the axis of rotation of the pivoting structure to be orientated in an oblique direction with respect to the median longitudinal axis of the frame.

With such a device, there is no need to space one's legs apart in an exaggerated way when using the rackets, because of the offcentering of the pivoting structure; and in addition there is no need to raise one's legs in an exaggerated way, because of the possibility of rotating the pivoting structure about its axis of rotation.

However, it has been discovered that these known rackets have insufficient holding power on hard snow, causing dangerous sliding.

Furthermore, the fastening for the shoe does not provide good holding of the foot when moving forwards, and mainly across slopes and downhill. Thus, the user cannot control the direction of the racket.

Furthermore, rotation of the pivoting structure with respect to the racket is not limited; during downhill travel, it frequently happens that the racket makes a complete revolution about the axis of rotation, causing dangerous falls.

SUMMARY OF THE INVENTION

The present invention overcomes the drawbacks of known devices by providing a new form of snowshoe providing permanently excellent holding even on hard snow, not only going uphill, but when going downhill or across slopes.

According to another object of the invention, the racket is provided with means for fastening a shoe providing permanently efficient interlocking of the shoe with the pivot pin; the user thus keeps control of the direction of his snowshoe.

The means for fastening the shoe are adjustable for accomodating various shoes of different sizes, the adjustment being very quickly achieved.

According to an important object of the invention, the racket is provided with means providing very good snow lift for a given racket area, without increasing the weight. In other words, the chosen racket structure allows a racket to be obtained with sufficient lift while substantially reducing the total area of the racket and its weight.

According to another object of the invention, the racket is particularly adapted for use across slopes, providing lateral penetration of the racket into the snow on the uphill side.

Furthermore, in use across slopes, with the special structure of the racket the outer edge of the uphill racket may be slid longitudinally in the snow. Thus the exertion required of the uphill leg are considerably reduced.

According to another object of the invention, the racket has a good drag effect without unduly braking forward movement.

It is well known that devices providing good hold on hard snow generally tend to produce a "booting" phenomenon by accumulation of packed snow on the under surface of the device. In the present invention, while providing a good hold capability, the racket also avoids the booting phenomena.

To attain these objects as well as others, the transverse pivot pin forms a spacer preventing the side members from drawing closer to each other; an intermediate transverse spacer connects the side members below the lattice work substantially below the heel of the user; the lattice work comprises a flexible strap stretched between the side members; a fin extends the outer side member outwardly over the whole of its length and forms a sliding bearing surface; the pivoting structure comprises a base plate having a front stirrup-piece and a rear heel-piece for holding respectively the front and rear of the shoe, fastening means allowing the shoe to be locked to the pivoting structure.

According to another characteristic of the invention the side members and endmost cross pieces have a T shaped section whose central leg is orientated towards the lower face of the frame and has a height between 15 and 30 mm, the height being gradually reduced in the rear zone of the frame so as to define a portion with less holding power. The presence of the central leg or lower rib provides excellent holding ability; associated with the flexible lattice and with the rear lesser holding portion, it produces no troublesome booting phenomenon.

According to another characteristic of the invention, the frame has a general oblong shape tapering rearwardly, the side members being substantially rectilinear and forming therebetween an angle between 10° and 20°, the endmost cross pieces forming a rounded profile.

These arrangements provide excellent holding power on all types of snow.

With the outer side fin, the user can easily cause the uphill racket to penetrate upwardly into the snow when crossing a slope and to cause it to slide longitudinally while only having to raise the downhill racket part. Furthermore, the fin substantially increases the bearing qualities, without increasing the weight and total area of the racket.

According to another characteristic of the invention, the racket comprises a removable strap of adjustable length which connects together the rear parts of the heel piece and the frame. The strap avoids complete rotation of the racket about the pivot pin and turning thereof.

BRIEF DESCRIPTION OF THE DRAWINGS

Other objects, features and advantages of the present invention will be clear from the following description of a particular embodiment made with reference to the accompanying Figures in which.

DESCRIPTION OF THE PREFERRED EMBODIMENTS

Figure 1:
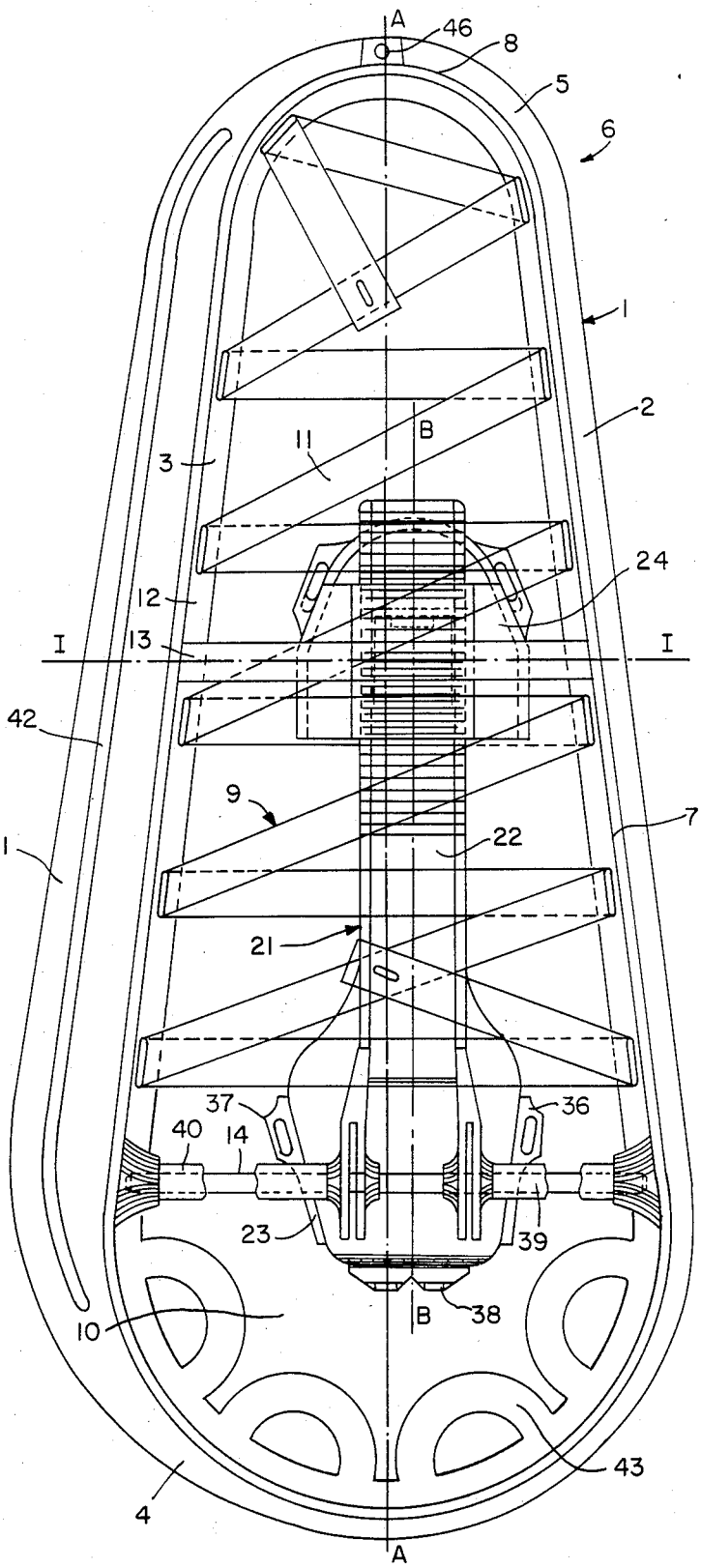
FIG. 1 is a general bottom view of a snowshoe in accordance with the invention for the left foot.
Figures 2, 3:
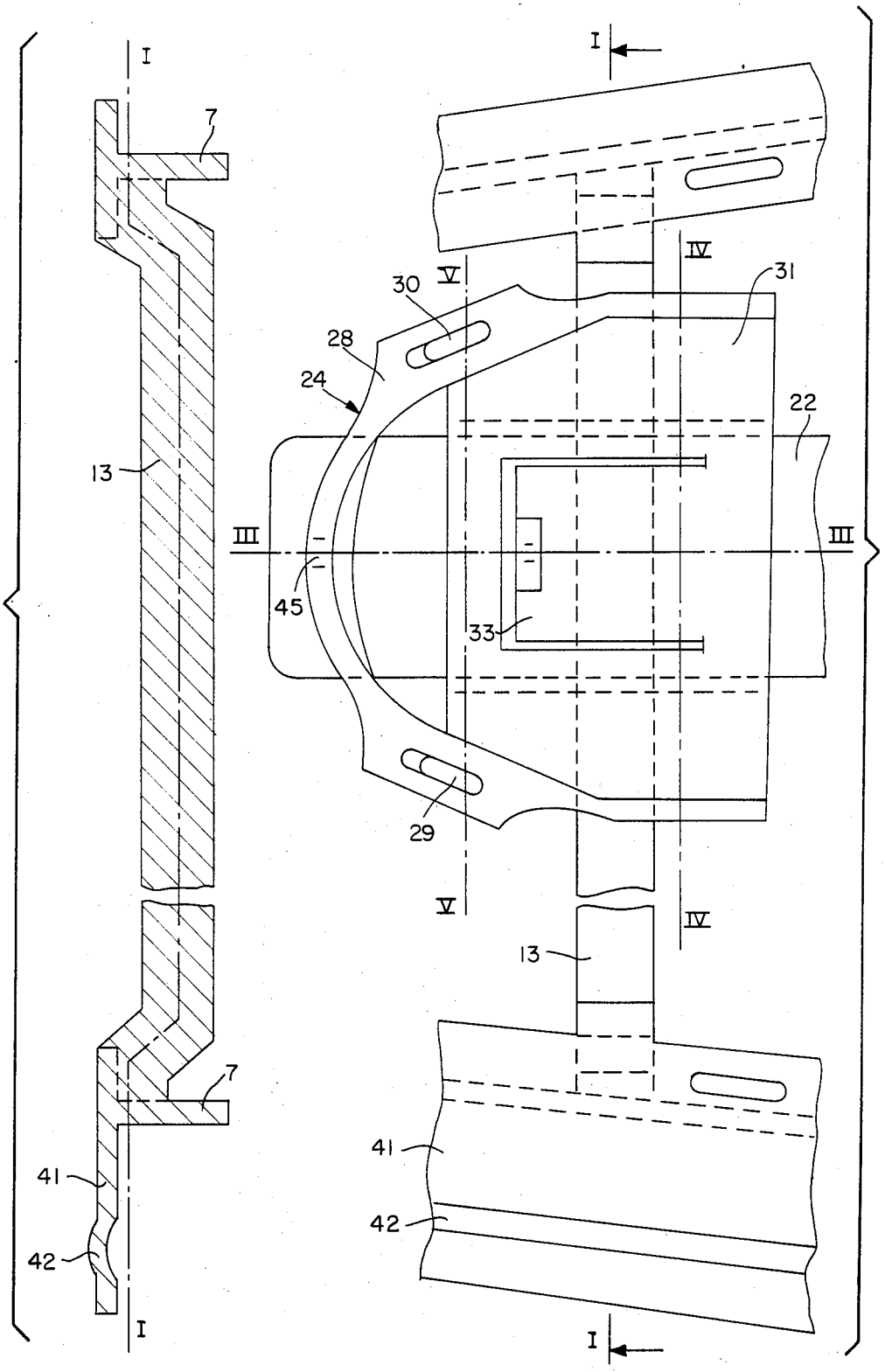
FIG. 2 shows a cross section through the axis I—I of FIG. 1.
FIG. 3 shows a partial top view of the snowshoe in the vicinity of the axis I—I of FIG. 1.

FIG. 1 is a bottom view of a snowshoe for the left foot in accordance with the invention. A snowshoe for the right foot may be obtained symmetrically with respect to the median longitudinal axis A—A.

As shown in this Figure, the snowshoe comprises a generally flat rigid frame 1, i.e. comprising a substantially flat part which may be raised at the front. The frame is formed from an inner side member 2 and an outer side member 3 joined together by a front end cross piece 4 and a rear end cross piece 5. The side members 2 and 3 are substantially rectilinear and the end cross pieces form a rounded profile, as can be seen in the Figure. The frame has a general oblong shape, tapering towards the rear 6, the side members forming therebetween an angle between 10° and 20°.

Side members 2 and 3 and end cross pieces 4 and 5 have a T shaped section whose central leg or rib is orientated towards the lower face of the frame, and has a height between 15 and 30 mm.

At the rear part 6 of the frame, the central leg 7 has a gradually decreasing height, reaching in the endmost rear zone 8 a height less than 15 mm.

The frame 1 has fixed thereto a central lattice 9 forming a perforated bearing surface having a front opening or toe passage 10. Lattice 9 comprises a flexible strap 11 passing successively through apertures in the inner side branch 12 of the side members 2 and 3. A strap may be successively used made from a nylon type polyamide ultrasonically welded at both ends. The strap is stretched while forming N shapes, as shown in FIG. 1, with alternately a cross leg and an oblique leg.

This arrangement guarantees a good tension of the lattice.

An intermediate transverse spacer 13 with a substantially circular section connects the side members 2 and 3 together below the lattice 9, in a substantially central position so as to be situated under the heel of the user.

Figure 13:
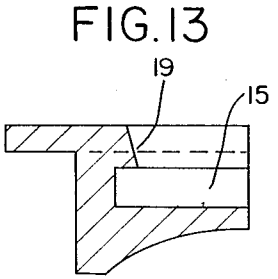
FIGS. 12 to 15 illustrate the method of fastening the pivot pin to the frame.
Figure 15:
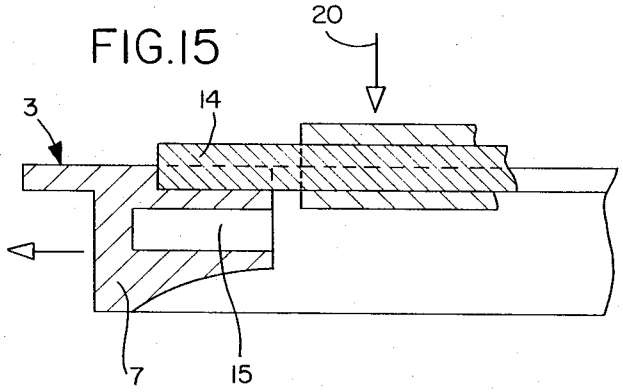
Figure 12:
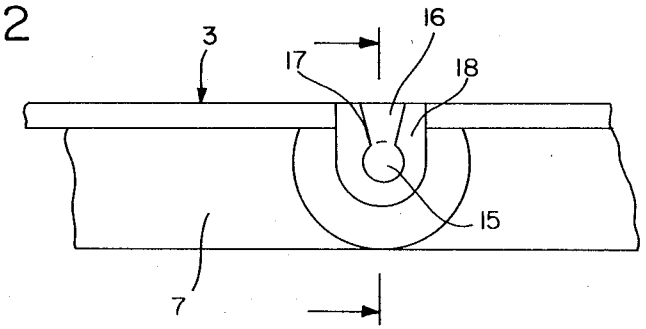
Figure 14:
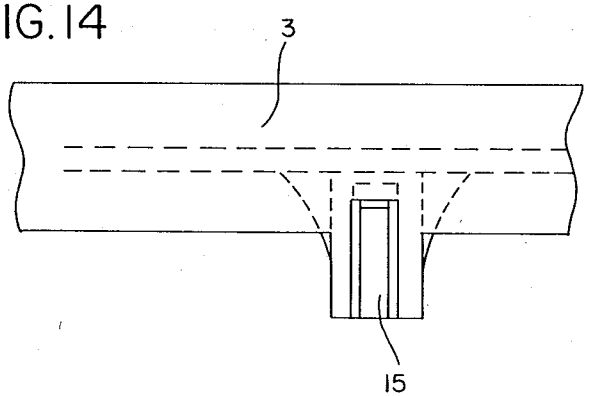

Frame 1 receives a transverse pivot pin 14, disposed at the rear end of the toe passage 10. The two ends of pin 14 are housed in the side members 2 and 3. As can be seen in FIG. 12, in a side view, the side member 3 has a housing 15 for receiving the pin 14. FIG. 13 shows the housing in cross section, FIG. 14 is a top view thereof and FIG. 15 illustrates the method of engaging the pin in its housing. As shown in these Figures, housing 15 is partially open at the top through an opening 16 limited by two lateral lips 17 and 18 and a transverse bevelled lip 19. Lips 17 and 18 are spaced apart by a distance slightly less than the diameter of pin 14, whereas the transverse lip 19 is spaced from the corresponding lip of the side member 2 by a distance slightly less than the length of pin 14. It will be readily understood that pin 14 is inserted by exerting a pressure thereon, as shown by arrow 20 so as to resiliently move the lips 17, 18 and 19 apart. The transverse pivot pin 14 forms a spacer preventing the side members from drawing close to each other.

Figure 8:
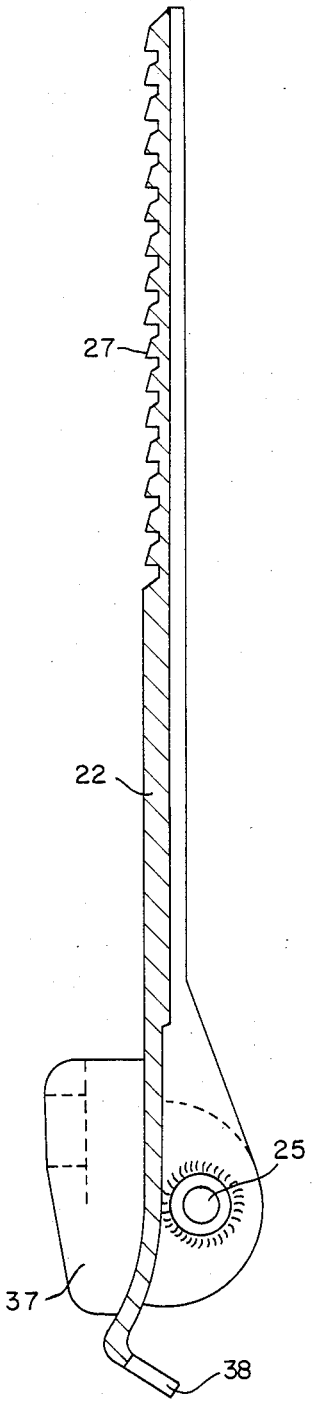
FIG. 8 shows a longitudinal sectional view through the axis II—II of FIG. 7.
Figure 7:
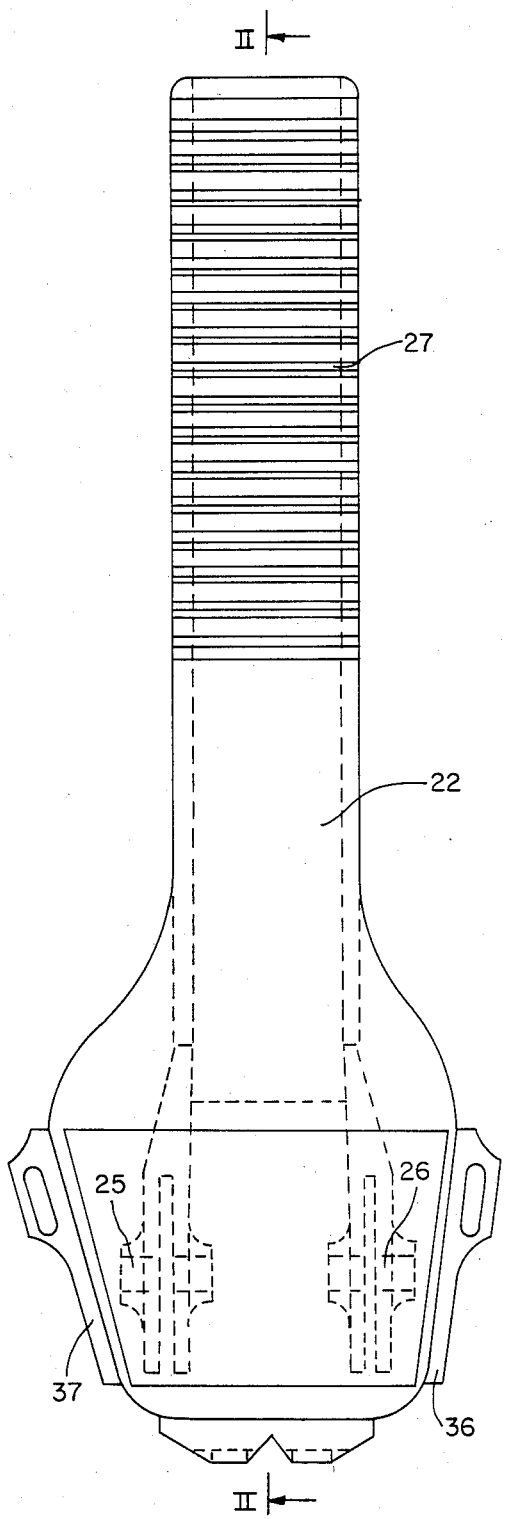
FIG. 7 shows a top view of the base plate and stirrup piece.
Figure 11:
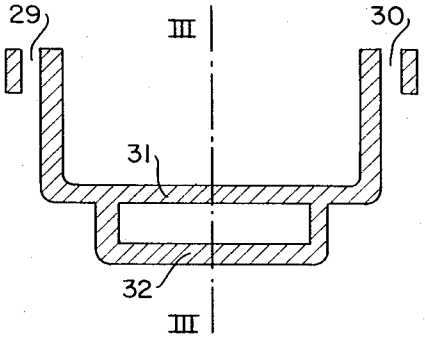
FIG. 11 shows a cross sectional view through the axis V—V of FIG. 3.
Figure 10:
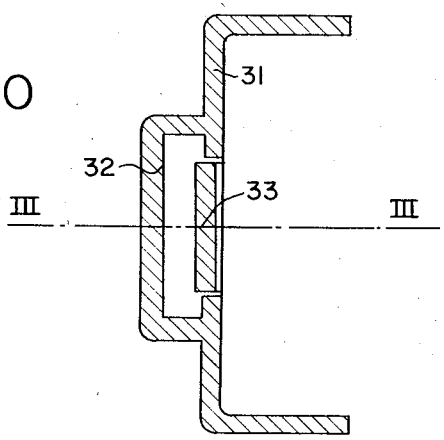
FIG. 10 shows a cross sectional view of the heel piece through the axis IV—IV of FIG. 3.
Figure 9:
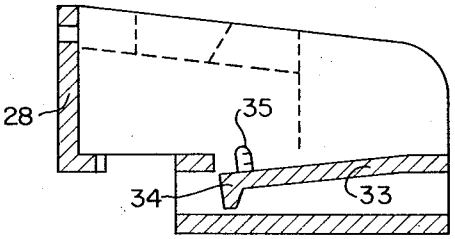
FIG. 9 shows a side view in longitudinal section of the heel piece through the axis III—III of FIG. 3.

The pivot pin 14 receives in its intermediate part, a pivoting structure 21 having fastening means for receiving and fastening the shoe of the user. The pivoting structure 21 comprises a rigid base plate 22 fixed to a front stirrup-piece 23 for holding the front of the sole of the shoe in position. The rear part of plate 22 receives a heel piece 24 fitted by means for adjusting it and locking it in the longitudinal position. As shown in FIGS. 7 and 8, the base plate comprises, at its front part, lower housings 25 and 26 forming bearings for passing the pivot pin 14 therethrough. Plate 22 comprises, in its rear part, upper serrations 27 cooperating with the means for adjusting the position of heel piece 24. As shown in FIGS. 3, 9, 10 and 11, the heel piece 24 comprises a body 28 against which the heel of the shoe comes into abutment; two oblong cut-outs 29 and 30 for passing therethrough a strap for fastening the shoe. Body 28 comprises a base with two walls 31 and 32 between which slides a plate 22. A resilient tongue 33 is cut out from the upper wall 31, its end comprising a projection 34 for penetrating, under the effect of the resilience of the tongue, in the serrations 27 of plate 22 for locking heel piece 24 in position on plate 22. A boss 35 may be provided in the upper part of tongue 33, which boss is pushed by the heel of the shoe and forces projection 34 into the serrations 27. Preferably, the serrations 27 have a disymmetrical profile, as shown in FIG. 8, with a rear slanting face and an upright front face, allowing adjustment by advancing the projection once the shoe is in position, the projection may only be moved backwards by raising tongue 33 by gripping projection 35.

Stirrup-piece 23 comprises two raised edges 36 and 37, with oblong apertures for passing therethrough a fastening strap. The edges are bent at 90° and are convergent for positioning and placing the shoe in abutment. The front part of stirrup-piece 23 is bent downwardly so as to form a crampon or spike 38, for increasing the holding power on hard snow.

Plate 22 is held laterally in position on pin 14 by two tubular spacers 39 and 40 of adequate length fitted onto pin 14, as shown in FIG. 1. The inner spacer 39 is slightly shorter than the outer spacer 40, so as to offset the pivoting structure 21 towards the inner side member 2.

The outer side member 3 is extended outwardly, over the whole of its length, by a fin 41 forming a solid bearing surface. In the embodiment shown, frame 1 has a T shaped section whose width is substantially equal to the height, the thickness of the legs of the T being preferably between 3 and 6 mm. Fin 41 may have the same thickness, between 3 and 6 mm, and forms a slightly flexible and relatively penetrating and sliding surface when the user applies the snow shoe on its edge in the snow. Fin 41 has a width preferably between 25 mm and 60 mm and may comprise a stiffening rib 42.

The front part of the bearing surface of the snow shoe comprises projections 43 on the front end cross piece 4 which extend rearwardly and form a bearing surface. The presence of the front end of the shoe close to this surface and the fact that the shoe pivots downwardly, avoids any booting phenomena at this level.

Figure 4:
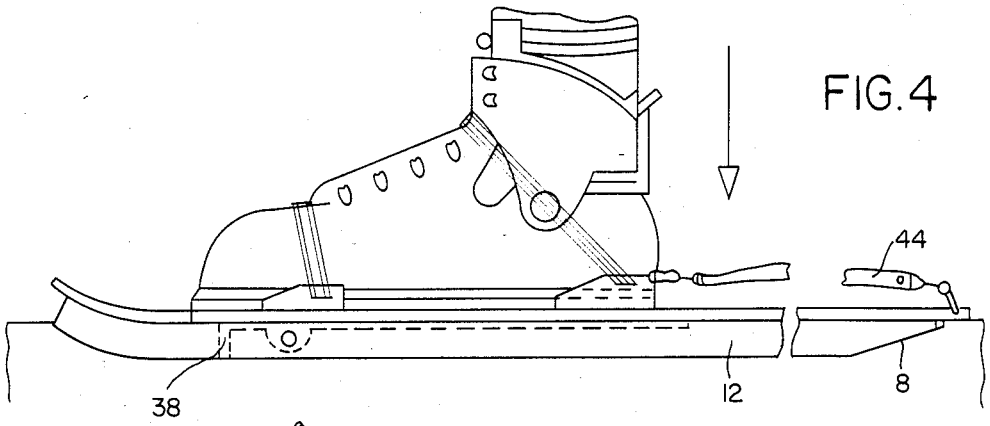
FIGS. 4, 5 and 6 illustrate the use of the snowshoe of the invention.
Figure 5:
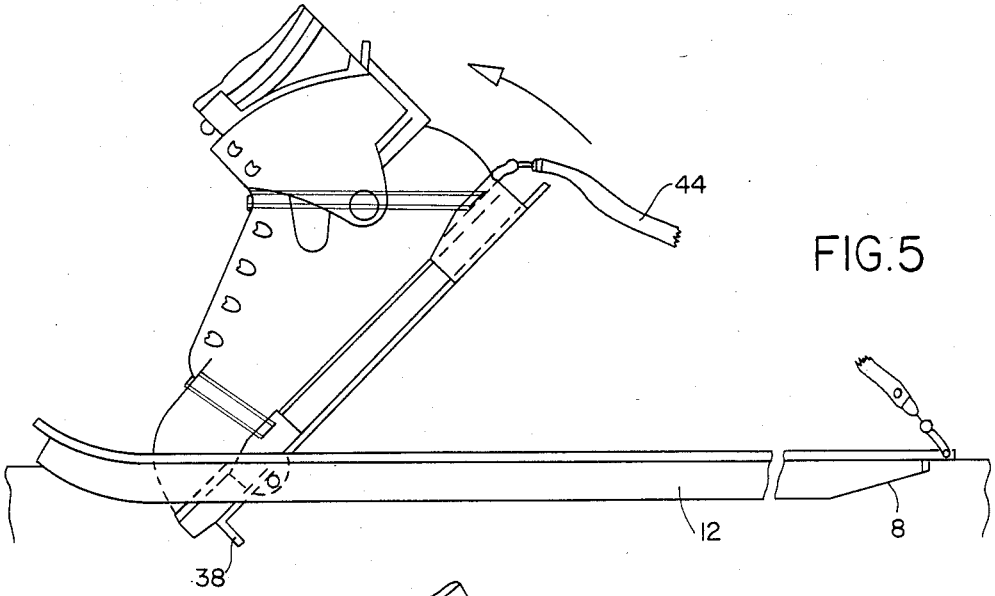
Figure 6:
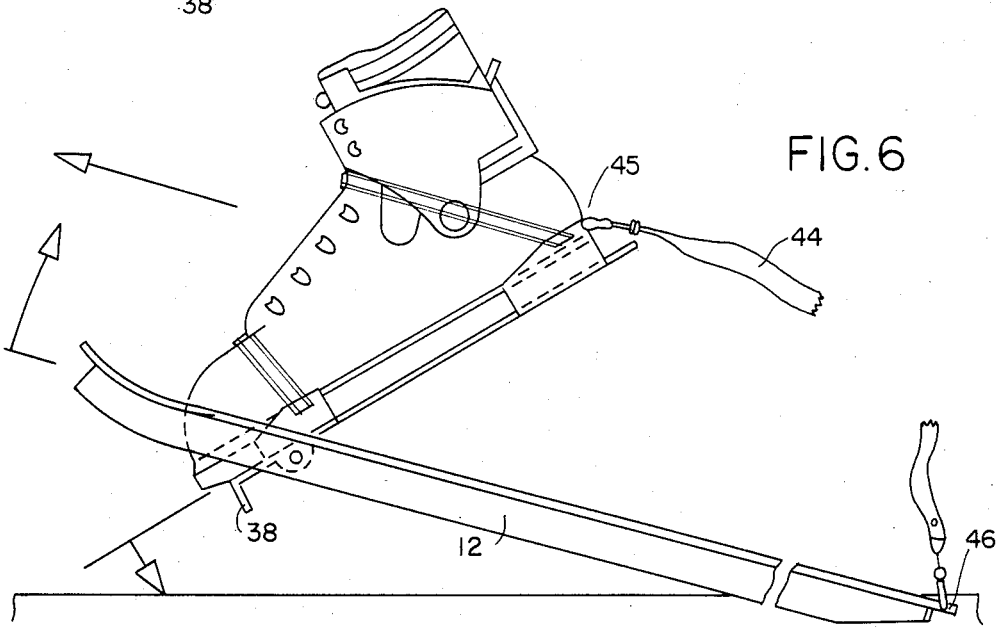

As shown in FIGS. 4 to 6, during use of the racket, the shoe pivots forwardly; when the user raises his foot, the rear of the racket remains in sliding contact with the ground, producing an advantageous drag effect. A removable strap 44 of adjustable length connects together the rear part 45 of the heel piece and the rear part 46 of the frame 1. Strap 44 allows free movement of the shoe up to a maximum slope fixed by the length of strap 44, avoiding complete turning over of the racket with respect to the shoe.

Frame 1 may be made from a molded plastic material, also comprising spacer 13 and projections 43.

The present invention is not limited to the embodiments which have been more explicitly described, but include the different variants and generalizations thereof contained within the scope of the following claims.

What is claimed is:

1. A snowshoe or racket, comprising a rigid generally flat frame formed from an inner side member and an outer side member joined together by a front end cross piece and a rear end cross piece, the frame having fixed thereto a central lattice forming a perforated bearing surface having a toe passage, said frame receiving a transverse pivot pin, disposed at the end of the toe passage, the two ends of said pin being housed in the side members and its intermediate part supporting a pivoting structure provided with fastening means for receivng and fastening the shoe of the user, wherein:

said side members each have identical cross setions, a fin portion extending outwardly from said identical cross sections only along a portion of said outer side member, said fin portion providing a sliding bearing surface; and the pivoting structure comprises a base plate having a front stirrup-piece and a rear heelpiece for holding respectively the front and the rear of the shoe, fastening means allowing the shoe to be fastened to said structure.

2. The snowshoe as claimed in claim 1, wherein said side members and said end cross pieces have a T shaped section whose central leg is orientated towards the lower face of the frame and has a height between 15 and 30 mm, its height decreasing gradually in the rear zone of the frame so as to define a portion with lesser holding power.

3. The snowshoe as claimed in claim 1, wherein said frame has a general oblong shape tapering rearwardly, said side members being substantially rectilinear and forming therebetween an angle between 10° and 20°, said end cross pieces forming a rounded profile.

4. The snowshoe as claimed in claim 1, wherein:

the transverse pivot pin forms a spacer preventing the side members from drawing closer to each other;

an intermediate transverse spacer of substantially circular section connects the side members together below the lattice in the zone situated below the heel of the user;

the lattice comprises a flexible strap stretched between said side members.

5. The snowshoe as claimed in claim 1, wherein said pivoting structure is mounted on said pivot pin so that the medium longitudinal axis of the structure is slightly offset inwardly with respect to the median longitudinal axis, the pivot pin being substantially perpendicular to the longitudinal axis of the frame.

6. The snowshoe as claimed in claim 1, wherein said stirrup-piece is fixed to the base plate, said heelpiece being fitted to said base plate by means for adjusting it and locking it in a longitudinal position.

7. The snowshoe as claimed in claim 1, further comprising a removable strap of adjustable length which connects together the rear parts of said heel piece and said frame.

8. The snowshoe as claimed in claim 1, wherein the front bearing surface of the racket is formed by projections on the front end cross piece.

9. The snowshoe as claimed in claim 1, wherein said fin portion has a width between 25 and 60 mm.

10. A snowshoe or racket, comprising a rigid generally flat frame formed from an inner side member and an outer side member joined together by a front end cross piece and a rear end cross piece, the frame having fixed thereto a central lattice forming a perforated bearing surface having a toe passage, said frame receiving a transverse pivot pin, disposed at the end of the toe passage, the two ends of said pin being housed in the side members and its intermediate part supporting a pivoting structure provided with fastening means for receiving and fastening the shoe of the user, wherein:

said outer side member is wider than said inner side member;

said outer side member extends outwardly from a longitudinal axis which extends between the remote extremities of said snowshoe by a greater distance than said inner side member extends outwardly from said longitudinal axis;

said frame is assymetrical; and the pivoting structure comprises a base plate having a front stirrup-piece and a rear heelpiece for holding respectively the front and the rear of the shoe, fastening means allowing the shoe to be fastened to said structure.

11. The snowshoe as claimed in claim 10, wherein each of said side members has a T-shaped section whose central leg is oriented towards the lower face of the frame, an outer leg of said T-shaped section extending outwardly from said central leg, said outer side member further including a fin portion extending from its outer leg outwardly by a distance which varies along the length of said frame, whereby the combined width of said outer side member's outer leg and fin portion is greater than the width of said inner side member's outer leg at points along the length of said frame.

12. The snowshoe as claimed in claim 11, wherein said fin portion includes a stiffening rib running along part of its length.

13. The snowshoe as claimed in claim 10, wherein said outer side member includes a fin portion which varies in width along the length of said frame, said fin portion extending outwardly from said outer said member, whereby said outer side member extends a further distance outwardly from said longtitudinal axis than said inner side member, whereby said fin portion provides a sliding bearing surface adjacent said outer side member.

* * * * *